US005737683A

United States Patent [19]

Sterzel

[11] Patent Number: 5,737,683

[45] Date of Patent: Apr. 7, 1998

[54] PROCESS FOR PRODUCING METALLIC SHAPED PARTS BY POWDER INJECTION MOLDING

[75] Inventor: Hans-Josef Sterzel, Dannstadt-Schauernheim, Germany

[73] Assignee: BASF Aktiengesellschaft, Ludwigshafen, Germany

[21] Appl. No.: 527,682

[22] Filed: Sep. 13, 1995

[30] Foreign Application Priority Data

Sep. 15, 1994 [DE] Germany ..... 44 32 797.8

[51] Int. Cl.[6] ..... B22F 3/12; B22F 5/00

[52] U.S. Cl. ..... 419/36; 419/38

[58] Field of Search ..... 419/38, 36

[56] References Cited

U.S. PATENT DOCUMENTS 3,857,157 12/1974 Smith et al. ..... 29/420.5
5,077,002 12/1991 Fried ..... 419/29

FOREIGN PATENT DOCUMENTS 413 231 2/1991 European Pat. Off. .
524 710 1/1993 European Pat. Off. .
633 440 1/1995 European Pat. Off. .
41 24 393 1/1928 Germany .

OTHER PUBLICATIONS

ASM Handbook, vol. 7, Powder Metallurgy, p. 395, Jan. 1984.

*Primary Examiner*—Daniel J. Jenkins
*Attorney, Agent, or Firm*—Keil & Weinkauf

[57] ABSTRACT

In a process for producing a metallic shaped part by processing an injection-molding composition, where a. the injection-molding composition is processed to give the shaped part and b. a part of the binder present in the shaped part is removed at from 90° to 600° C. and c. the shaped part thus obtained is sintered, the shaped part is sintered on a support which has approximately the contour of the finished shaped part, with the contour of the support being essentially maintained during the sintering process.

4 Claims, No Drawings

PROCESS FOR PRODUCING METALLIC SHAPED PARTS BY POWDER INJECTION MOLDING

The present invention relates to an improved process for producing metallic shaped parts by processing an injection-molding composition, where a.) the injection-molding composition is processed to give the shaped part and b.) a part of the binder present in the shaped part is removed and c.) the shaped part thus obtained is sintered.

Various processes are already known for producing metallic shaped parts by metal powder injection molding. EP-A 413 231 describes a process for producing inorganic sintered shaped parts. In a first step, a moldable composition in the form of granules is prepared from the sinterable powder and polyoxymethylene as binder. Green bodies are subsequently produced from these moldable compositions by injection molding. For this purpose, the granular material is melted in injection-molding machines and the melt is injected into the appropriate molds where it cools as the temperature is lowered and solidifies as the temperature falls below the glass transition temperature and/or the crystallite melting point of the binder, and the moldings are subsequently removed from the mold (page 1, line 38 to page 2, line 2). The green bodies thus obtained are freed of the major part of the binder in the subsequent binder removal step, with acid-catalyzed binder removal offering the advantage; by means of the gentle removal of the binder, of suppressing the danger of crack formation (page 2, lines 3 to 32). The porous parts thus obtained are subsequently sintered at from about 1100° to 1500° C., during which further small amounts of residual binder may escape (page 2, lines 33 to 34).

The process is generally very suitable for producing inorganic sintered shaped parts but, for example, in the case of large parts which may have complicated shapes and/or low wall thicknesses, undesired distortions can occur during sintering. The sintering process requires high temperatures to produce the desired microstructure in the shaped body. The temperatures are customarily from about 1100° to 1500° C. However, at these high temperatures a certain amount of softening of the shaped body to be sintered cannot be ruled out. This can lead to undesired distortions, for example in the case of cutlery parts which rest only very incompletely on planar supports during the sintering process, since the shaped body is subjected to significant stressing under its own weight alone.

DE-C 4124393 discloses cutlery parts which are produced by powder-metallurgical injection molding. Here too, a process is described in which the shaped bodies are essentially produced by the process steps of injection molding, removal of the binder and subsequent sintering of the shaped body (column 2, lines 58 to 64). This also has the disadvantage that undesired distortion can result during sintering of the cutlery parts which have been produced by powder-metallurgical injection molding.

It is an object of the present invention to find an economical and inexpensive process which helps overcome the said disadvantages and which leads, even in the case of parts having thin walls or a complicated shape, to products of high and uniform quality.

We have found that this object is achieved by a process for producing a metallic shaped part by processing an injection-molding composition, where a. the injection-molding composition is processed to give the shaped part and b. a part of the binder present in the shaped part is removed at from 90° to 600° C. and c. the shaped part thus obtained is sintered, by sintering the shaped part on a support which has approximately the contour of the finished shaped part, with the contour of the support being essentially maintained during the sintering process.

The invention further provides the shaped parts obtainable using the process.

The supports used in the process of the invention ensure good shape stability of the shaped part during the sintering process. Supports which are particularly useful are those which advantageously have approximately the contour of the finished shaped part, have a higher creep resistance than the shaped part or do not creep detectably in the sintering temperature range under the action of the loads placed on them.

Various materials can be used for the supports. When using metallic materials, care has to be taken to ensure that undesired sintering between the shaped part and the support does not occur during the sintering process. This can, however, be prevented by various measures such as, for example, coating the support with inert powders such as boron carbide, boron nitride or α-aluminum oxide. Ceramic materials are particularly useful, for example sintered aluminum oxide, zirconium dioxide, silicon carbide, aluminum nitride, boron carbide or boron nitride.

For some shaped parts, the support can be preferably produced directly using the mold for the metallic shaped part. This is the case, for example, for the support for producing spoons. Here, the mold can be used for injection molding to produce a support which later serves as the support for the metallic shaped parts. The dimensions of the finally sintered support can here be advantageously made somewhat larger than the future shaped part, so that the support has a shape which is a good match for the shaped parts. It is here advisable to make the dimensions of the support from about 1 to 20% larger than the shaped part particularly preferably from 2 to 10%. The measures necessary to set the dimensions are known to those skilled in the art. Thus, for example, the shrinkage of the shaped body is dependent on the composition of the starting materials used and can be correspondingly varied. Furthermore, the sintering temperature can be used to influence the shrinkage: raising the sintering temperature gives greater shrinkage of the shaped part.

The process for producing metallic shaped parts is schematically described in more detail below.

A granular material is prepared in a known way from sinterable metal powder, a binder which is able to flow and, if desired, further additions of processing aids. Numerous materials are known as binders which are able to flow. The important thing is that they produce as little residual carbon as possible when the temperature is increased. Examples are polyoxymethylene, polystyrene, polymethyl methacrylate, polypropylene, polyethylene, ethylene/vinyl acetate copolymers and mixtures of these.

The polyoxymethylene homopolymers or copolymers are known per se to those skilled in the art and are described in the literature.

The homopolymers are generally prepared by polymerization of formaldehyde or trioxane, preferably in the presence of suitable catalysts.

Polyoxymethylene copolymers preferred for the purposes of the invention contain, besides the recurring —$OCH_2$— units, additionally up to 50 mol %, preferably 0.1–20 mol % and in particular 0.3–10 mol %, of recurring

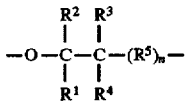

units, where $R^1$ to $R^4$ are, independently of one another, hydrogen, $C_1$–$C_4$-alkyl or halogen-substituted alkyl having 1–4 carbon atoms and $R^5$ is —$CH_2$—, —$CH_2O$—, a methylene group substituted by $C_1$–$C_4$-alkyl or $C_1$–$C_4$-haloalkyl or a corresponding oxymethylene group and n has a value in the range 0–3. Advantageously, these groups can be introduced into the copolymers by ring opening of cyclic ethers. Preferred cyclic ethers are those of the formula

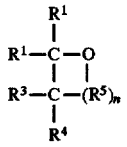

where $R^1$–$R^5$ and n are as defined above. Examples are ethylene oxide, 1,2-propylene oxide, 1,2-butylene oxide, 1,3-butylene oxide, 1,3-dioxane, 1,3-dioxolane and dioxetane as cyclic ethers and also linear oligoformals as comonomers.

Likewise useful are oxymethylene terpolymers which are prepared, for example, by reacting trioxane, one of the above described cyclic ethers and a third monomer, preferably a bifunctional compound of the formula

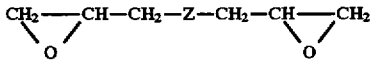

where Z is a chemical bond, —O— or —ORO— (R=$C_1$–$C_8$-alkylene or $C_3$–$C_8$-cycloalkylene).

Preferred monomers of this type are ethylene diglycide, diglycidyl ether and diethers of glycidylene and formaldehyde, dioxane or trioxane in a molar ratio of 2:1 and also diethers of 2 mol of glycidyl compound and 1 mol of an aliphatic diol having 2–8 carbon atoms such as, for example, the diglycidyl ethers of ethylene glycol, 1,4-butanediol, 1,3-butanediol, cyclobutane-1,3-diol, 1,2-propanediol and cyclohexane-1,4-diol, to name only a few examples.

Apart from the polyoxymethylene homopolymers and copolymers, other suitable polymers are poly-1,3-dioxolane and poly-1,3-dioxetane as described, for example, in EP-A-44 475. Processes for preparing the above described homopolymers and copolymers are known to those skilled in the art and are described in the literature, so that no further details are required here.

The preferred polyoxymethylene homopolymers or copolymers have melting points of at least 150° C. and molecular weights (weight average) in the range from 5000 to 15,000, preferably from 7000 to 60,000.

Examples of metals which can be present in powder form are iron, cobalt, nickel and silicon; alloys are, for example, iron-based alloys such as low alloy and high alloy steels, light metal alloys based on aluminum and titanium and also alloys with copper or bronze. Finally, cemented hard materials such as tungsten carbide, boron carbide or titanium nitride in combination with metals such as cobalt and nickel are also suitable. The latter can be used in the production of metal-bonded hard cutting tools (cermets).

Examples of processing aids used are flow improvers, stabilizers or mold-release agents.

The granular material is used to produce a green body by injection molding in a known manner. For this purpose, the granular material is melted in injection-molding machines at from about 120° to 220° C., preferably from 170° to 200° C., and the melt is injected into the appropriate mold where it cools as the temperature is lowered and solidifies when the temperature falls below the glass transition temperature and/or the crystallite melting point of the binder, and the parts are subsequently removed from the mold.

The green bodies thus obtained are freed of the major part of the binder present in the subsequent binder removal step at from about 90° to 600° C. It can also be advisable to carry out the binder removal in the presence of an acid, which makes possible lower binder removal temperatures as a result of acid-catalyzed dissociation of the binder. Suitable acids are, for example, nitric acid, oxalic acid or boron trifluoride; the temperatures during binder removal are here usually from about 110° to 150° C.

It can be particularly advisable to add, right at the beginning of the process, small amounts of a further permanent binder which is not removed in the acid-catalyzed binder removal.

The residues of the binder thus remaining ensure good strength of the shaped body even at the beginning of the sintering process before commencement of strengthening as a result of the sintering of the metal particles.

Suitable permanent binders are, for example, polyethylene, polypropylene, polystyrene, polymethyl methacrylate or polyvinylpyrrolidone.

The proportion of the permanent binder is preferably from about 0.5 to 20% by weight, particularly preferably from 2 to 10% by weight, based on the total binder used.

In the subsequent sintering process, the shaped part is strongly heated as a result of which the microstructure is changed in the desired way and any remaining binder residues can be driven off. For this purpose, the shaped part to be sintered is placed on a support which stabilizes the contours of the shaped part. The temperatures during the sintering process are usually from about 600° to 1600° C., preferably from 800° to 1400° C., the duration of sintering is usually from about 0.5 to 10 hours, preferably from 1 to 2 hours, excluding heating and cooling times.

The support should here be such that the shaped part to be sintered rests not only on a few points, but has a large area of contact with the support, so that good stabilization during sintering is ensured. Care should be taken to ensure that the support itself has sufficient creep stability at the sintering temperatures.

The process of the invention is particularly suitable for producing components having thin walls, large size or complex shape, which without such support would tend to deform even under their own weight as soon as the creep resistance of the material is reduced. This allows the possibility of using powder injection molding to produce even those shaped parts which could previously not be made by this method because of the undesired deformation. Besides the case of the shaped parts already mentioned, this is relevant wherever high dimensional accuracy is required. Using the process of the invention, it is usually possible to achieve a dimensional accuracy in the finished shaped parts which does not exceed about 0.5%, in particular cases 0.3%, based on the prescribed value.

Examples are cutlery parts such as knife, fork and spoon and also shaped bodies having projecting parts which otherwise easily kink under their own weight.

The process of the invention offers a simple way of producing shaped parts economically and inexpensively, with high dimensional accuracy being able to be achieved together with an overall high level of properties, even for components of complex shape. At the same time, the process can advantageously be integrated without greater expense into existing injection-molding processes for producing metallic shaped parts.

EXAMPLES

In an evacuable compounder heated to 185° C., 10.080 g of a stainless steel powder of the grade 316 L, atomized in argon, having a mean particle size of 22 μm, 886.5 g of a polyoxymethylene having a melt flow index of 50 g/10 min at 190° C., 98.5 g of a polyethylene having a melt flow index of 42 g/10 min at 190° C. and also 500 g of butyl glycol as solvent for the binder component were mixed. After a homogeneous mixture had been obtained, the compounder was evacuated and the solvent was distilled off while compounding further. The compounder was then cooled to 100° C., with the composition solidifying and thus being granulated. The injection-molding composition thus obtained contained 63% by volume of the stainless steel powder.

An injection-molding machine was fitted with a mold for a spoon. The sintered spoon has a total length of 204 mm, a handle length of 140 mm, a spoon width of 44 mm, a curvature of the spoon of 9 mm, a curvature of the handle when laid on a flat support of 12 mm, and wall thicknesses of 1 mm in the spoon part and 3 mm in the handle. Based on the expected linear sintering shrinkage of 14.5%, the mold is 14.5% larger in all dimensions than the spoon. The injection-molding composition was melted at a composition temperature of 190° C. and injected into the mold which was at 110° C. After a cooling time of about 20 seconds, the green parts were taken from the mold.

To produce the sintering support, a composition comprising 56% by volume of aluminum oxide powder having a mean particle size of 1.2 μm and 44% by volume of a binder composed of 88% by weight of a polyoxymethylene, melt flow index 50 g/10 min at 190° C., and 12% by weight of a polybutanediol formal having a mean molecular weight around 60,000 was injected into the same mold.

The green spoon part containing the metal powder was freed of binder over a period of 1 hour at 120° C. in a nitrogen atmosphere containing about 1.5% of concentrated nitric acid.

The sintering support was freed of binder in the same apparatus over a period of 2.5 hours at 130° C. in a nitrogen atmosphere likewise containing about 1.5% of concentrated nitric acid. The binder-free sintering support was then heated in air to 1540° C. at a rate of 3° C./min, held at 1540° C. for 2 hours and then cooled at 5° C./min.

The dimensions of the sintering support thus obtained, which was not sintered to full density, are about 4% larger than those of the final sintered metal spoon.

The green spoon part containing the binder-free metal powder was laid on a sintering support and was heated to 1300° C. at a rate of 5° C./min under hydrogen having a dew point of less than −80° C. in a sintering furnace fitted with molybdenum heating elements, sintered for 120 minutes at 1300° C. and the sintering furnace was then cooled. This gave a spoon having exactly the correct dimensions.

COMPARATIVE EXAMPLE

The green parts obtained as described in Example 1 were freed of the binder component by heating the parts at a rate of 1° C./min from 160° C. to 210° C., at 0.5° C./min from 210° C. to 250° C. and at 2° C./min from 250° C. to 600° C., without the parts being placed on the sintering support having a spoon shape. After opening the binder removal furnace, it was found that the spherical parts of spoon and handle had sunk under the force of gravity and the curvatures had partially collapsed.

The green parts were placed on conventional flat aluminum oxide supports and then, as in the previous example, heated at a rate of 5° C./min to 1300° C. in the sintering furnace under hydrogen and held at 1300° C. for a further 120 minutes. The furnace was then cooled and opened. The curved contours of the spoon had flattened out further.

We claim:

1. A process for producing a metallic shaped article by injection molding in the following sequence, a) an injection molding composition is injected into a mold to give a shaped article, b) the shaped part is removed from the mold, and c) the shaped article thus obtained is sintered, wherein the sintering is on a non-flat support which has approximately the contour of the finished shaped article, the contour of the non-flat support being maintained stable during sintering except for insignificant creep.

2. A process as claimed in claim 1, wherein the support is built up of ceramic materials.

3. A process as claimed in claim 1, wherein the support is produced by injection molding.

4. A process as claimed in claim 2, wherein the support is produced by injection molding.

* * * * *